US010461410B2

(12) United States Patent
Fedan

(10) Patent No.: US 10,461,410 B2
(45) Date of Patent: Oct. 29, 2019

(54) COAXIAL HELIX ANTENNAS

(71) Applicant: CalAmp Wireless Networks Corporation, Irvine, CA (US)

(72) Inventor: Orest Fedan, Irvine, CA (US)

(73) Assignee: CalAmp Wireless Networks Corporation, Irvine, CA (US)

( * ) Notice: Subject to any disclaimer, the term of this patent is extended or adjusted under 35 U.S.C. 154(b) by 0 days.

(21) Appl. No.: 15/422,124

(22) Filed: Feb. 1, 2017

(65) Prior Publication Data

US 2018/0219280 A1 Aug. 2, 2018

(51) Int. Cl.

| | |
|---|---|
| ***H01Q 1/36*** | (2006.01) |
| ***H01Q 1/32*** | (2006.01) |
| *H01R 24/40* | (2011.01) |

(52) U.S. Cl.

CPC ..... *H01Q 1/362* (2013.01); *H01Q 1/3291* (2013.01); *H01R 24/40* (2013.01)

(58) Field of Classification Search

CPC ..... H01Q 1/362; H01Q 5/10; H01Q 1/3291; H01R 24/40; H01R 203/00

See application file for complete search history.

(56) References Cited

U.S. PATENT DOCUMENTS

| | | | | |
|---|---|---|---|---|
| 1,495,537 | A | 5/1924 | Stafford et al. | |
| 3,503,075 | A | 3/1970 | Gerst | |
| 4,608,574 | A | 8/1986 | Webster et al. | |
| 5,450,093 | A | 9/1995 | Kim | |
| 5,635,945 | A * | 6/1997 | McConnell | H01Q 1/362 343/860 |
| 5,708,448 | A | 1/1998 | Wallace et al. | |
| 5,896,113 | A | 4/1999 | O'Neill et al. | |
| 5,986,619 | A * | 11/1999 | Grybos | H01Q 1/288 343/853 |
| 5,986,621 | A | 11/1999 | Barts et al. | |
| 5,990,848 | A * | 11/1999 | Annamaa | H01Q 11/08 343/725 |
| 6,133,891 | A * | 10/2000 | Josypenko | H01Q 1/362 343/860 |
| 6,229,499 | B1 | 5/2001 | Licul et al. | |
| 6,653,987 | B1 | 11/2003 | Rosario et al. | |
| 7,158,819 | B1 * | 1/2007 | Pulimi | H01Q 1/362 343/702 |
| 8,013,735 | B2 | 9/2011 | Arpin et al. | |
| 8,630,605 | B2 | 1/2014 | Meacci et al. | |
| 8,787,823 | B2 | 7/2014 | Justice | |
| 9,088,398 | B2 | 7/2015 | Rhodes et al. | |
| 9,171,460 | B2 | 10/2015 | Chen | |
| 9,406,222 | B2 | 8/2016 | Hergesheimer et al. | |

(Continued)

*Primary Examiner* — Dameon E Levi
*Assistant Examiner* — David E Lotter
(74) *Attorney, Agent, or Firm* — KPPB LLP

(57) ABSTRACT

Coaxial helix antennas in accordance with embodiments of the invention are disclosed. In one embodiment, a coaxial helix antenna includes an inner element having an inner element radius and an inner element length and an outer element having an outer element radius and an outer element length, wherein the outer element radius is greater than the inner element radius, wherein the inner element is driven by a first conductor, wherein the outer element is driven by a second conductor, and wherein the outer element is disposed outside of the inner element such that a portion of the inner element extends beyond the outer element and includes an inner radiating element.

14 Claims, 1 Drawing Sheet

(56) References Cited

U.S. PATENT DOCUMENTS

| | | | | |
|---|---|---|---|---|
| 9,484,628 | B2 * | 11/2016 | Petros | H01Q 1/362 |
| 2006/0071873 | A1 | 4/2006 | Warnagiris et al. | |
| 2008/0094308 | A1 * | 4/2008 | Cowles | H01Q 1/08 343/895 |
| 2008/0231542 | A1 * | 9/2008 | Huang | H01Q 1/2266 343/895 |
| 2008/0246679 | A1 * | 10/2008 | Martek | H01Q 1/362 343/793 |
| 2011/0215984 | A1 | 9/2011 | Coburn et al. | |
| 2015/0214607 | A1 * | 7/2015 | Lee | H01Q 9/34 343/713 |

* cited by examiner

COAXIAL HELIX ANTENNAS

FIELD OF THE INVENTION

The embodiments relate to dipole radio frequency antennas.

BACKGROUND

A variety of different types of antennas can be used in mobile applications, including antennas that are external to the device and antennas that can be embedded within a device. The resonance of such antennas typically depends upon the dimensions of the antenna. Generally, the lower the resonant band of the antenna the larger the antenna. A single antenna element can be used to transmit in multiple bands. However, wide-band operation of an antenna element typically sacrifices performance of the antenna elements and such wide-band operation is only practical for relatively closely spaced operating frequency bands. Therefore, operation at multiple frequency bands is typically supported using multiple antenna elements. In a multiple-element antenna, different antenna elements are commonly tuned for operation at different operating frequency bands.

SUMMARY OF THE INVENTION

Coaxial helix antennas in accordance with embodiments of the invention are disclosed. In one embodiment, a coaxial helix antenna includes an inner element having an inner element radius and an inner element length and an outer element having an outer element radius and an outer element length, wherein the outer element radius is greater than the inner element radius, wherein the inner element is driven by a first conductor, wherein the outer element is driven by a second conductor, and wherein the outer element is disposed outside of the inner element such that a portion of the inner element extends beyond the outer element and includes an inner radiating element.

In another embodiment of the invention, the coaxial helix antenna is connected to a coaxial cable and the coaxial cable includes a conductor and an outer shield.

In an additional embodiment of the invention, the outer element is coupled to the conductor such that the second conductor includes the conductor of the coaxial cable and the inner element is coupled to the outer shield such that the first conductor includes the outer shield of the coaxial cable.

In yet another additional embodiment of the invention, the coaxial helix antenna further includes a BNC connector, the inner element and the outer element are connected to the BNC connector, the coaxial cable is connected to a mating BNC connector capable of engaging with the BNC connector, the inner element is electrically coupled to the outer shield via the BNC connector when engaged with the mating BNC connector, and the outer element is electrically coupled to the conductor via the BNC connector when engaged with the mating BNC connector.

In still another additional embodiment of the invention, the outer element and the inner element are wound in an opposite manner.

In yet still another additional embodiment of the invention, the outer element is wound in a clockwise manner and the inner element is wound in a counter-clockwise manner.

In yet another embodiment of the invention, the inner element is wound in a clockwise manner and the outer element is wound in a counter-clockwise manner.

In still another embodiment of the invention, the coaxial helix antenna is installed within the frame of a vehicle, where the frame of the vehicle is constructed using a conductive material.

In yet still another embodiment of the invention, the coaxial helix antenna further includes an insulator located between the inner element and the outer element.

In yet another additional embodiment of the invention, the insulator does not extend beyond the outer element.

DETAILED DESCRIPTION

Figure 1:
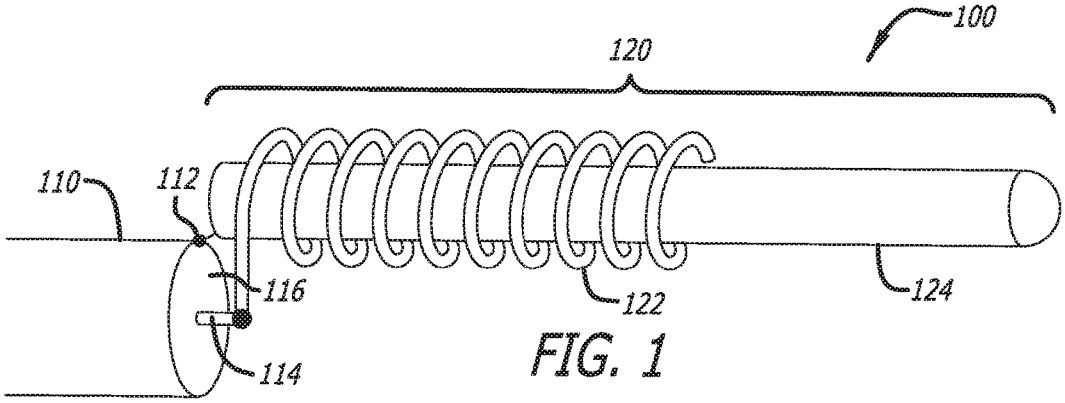
FIG. 1 is a conceptual illustration of a coaxial helix antenna in accordance with an embodiment of the invention.

Turning now to the drawings, coaxial helix antennas in accordance with embodiments of the invention are disclosed. Dipole antennas are commonly utilized to receive and transmit radio frequency (RF) signals. Dipole antennas are commonly constructed with two identical conductive elements and have a feed line located at the center of the structure, resulting in a bilaterally symmetrical antenna. Each side of the feed line is connected to one of the conductors. The feed line can then be used to apply a driving current for transmitting a signal or to obtain a received signal. A normal dipole antenna is tuned to resonate at a particular frequency and, based on the desired frequency, is usually one-half wavelength long in order to resonate unless it is reactively loaded. The resonating dipole antenna creates both electrical and magnetic fields. However, if a dipole antenna is shortened and then reactively loaded to make it resonant, the resonance has a very narrow bandwidth and is easily detuned when placed close to conductive materials, such as metal structures. As a normal dipole antenna nears conductive materials, the electric field is affected more than the magnetic field. As the dipole antenna further nears the conductive materials, the magnetic field is also affected. Affecting the electrical field reduces the resonant frequency of the dipole antenna, while affecting the magnetic field increases the resonant frequency. However, the changes in the resonant frequency reduces radiation efficiency of the dipole antenna. A second type of antenna is a helical antenna; helical antennas are a form of monopole antenna including a conducting wire wound in the form of a helix and are mounted over a ground plane. The feed line of a helical antenna is connected between one end of the conducting wire and the ground plane. Helical antennas are commonly one-quarter wavelength of the desired resonant frequency. However, helical antennas are limited in that, as an electrically short monopole antenna, the communication range of helical antennas is shorter than that of a full-size antenna. Additionally, the effectiveness of the helical antennas can be limited in environments where a ground plane is unavailable or the antenna is likely to contact multiple ground planes, such as in environments containing a large amount of conductive materials like automobiles. Further, the detuning of an antenna in the presence of conductive materials is affected by the distance to nearby conductive materials and this distance is based on the length of the radiating element of the antenna, where smaller radiating elements are less affected at a given distance than larger radiating elements.

Coaxial helix antennas in accordance with embodiments of the invention are designed to overcome these limitations of dipole antennas, particularly when installed in environments having conductive materials. The antenna of this proposal is considerably shorter and is not as easily detuned when placed close to metal, so it can be installed in environments with conductive materials and is easier to conceal than prior art designs. In many embodiments, coaxial helix antennas are dipole antennas with half of the dipole antenna wound over itself as an outer coil over an inner coil. In a variety of embodiments, the outer coil is wound in the opposite fashion to the inner coil to de-emphasize radial magnetic coupling between the inner and outer coils. This design reduces the change in the resonant frequency in the proximity of conductive materials as the main radiating element is shorter than in the prior art antennas, including monopole antennas tuned to resonate at a similar frequency. This design also reduces the change in the resonant frequency in the proximity of conductive materials by emphasizing the magnetic field relative to the electric field in the proximity of the antenna. Additionally, coaxial helix antennas in accordance with embodiments of the invention can stabilize their resonant frequency and thereby maintain high radiation efficiency in the presence of conductive materials. This is due to the structure of the coaxial helix antenna; when the antenna is close enough to a conductive material to affect the electrical field of the main radiating element (e.g. the inner coil); the other element (e.g. the outer coil) is even closer to the conductive material such that its magnetic field will be affected. Accordingly, these effects cancel each other out and the resonant frequency of the coaxial helix antenna is unaffected.

Furthermore, the topology of the coaxial helix antenna means that the coaxial helix antenna does not require a ground plane and has a shortened radiating length while maintaining resonance without the use of reactive components, thus maximizing the bandwidth of the antenna. In a variety of embodiments, reactive components include inductors and/or capacitors. An inductor is a tightly wound coil designed to contain most of its magnetic field and to radiate less of its magnetic field. A capacitor is made of two plates close together designed to contain most of its electric field between the plates and to radiate less of its electric field. These reactive components can be used to bring an electrically short antenna into resonance but commonly cannot be tailored to react to the environment in which the antenna is utilized as most of the fields of the reactive components (magnetic or electric) are contained and therefore not affected by the environment. Furthermore, such reactive components do not increase the radiation resistance by having contained fields that minimize radiation. Accordingly, these reactive components tend to decrease the bandwidth of the antenna as the bandwidth of an antenna is proportional to its radiation resistance.

Coaxial Helix Antennas

Turning now to FIG. 1, a coaxial helix antenna system in accordance with an embodiment of the invention is shown. The coaxial helix antenna system 100 includes a coaxial helix antenna 120 connected to a coaxial cable 110. The coaxial cable contains an outer shield 112 and a conductor 114 separated by an insulator 116. The coaxial helix antenna 120 includes an outer element 122 and an inner element 124. In the illustrated embodiment, the outer element 122 is connected to the conductor 114 and the inner element 124 is connected to the outer shield 112. However, it should be noted that the outer element 122 can be connected to the outer shield 112 and the inner element 124 can be connected to the conductor 114 as appropriate to the requirements of specific applications of embodiments of the invention.

In many embodiments, the coaxial cable 110 is connected to a device that is to transmit and/or receive RF signals. Any of a variety of devices, including those described herein, can be utilized in accordance with embodiments of the invention. However, as coaxial helix antennas do not require a ground plane, they can be driven directly by the device and not require the coaxial cable 110. This is in contrast to a variety of prior art antenna systems that depend on a coaxial cable being present between the device generating the RF signal and the antenna because these systems utilize the outer shield of the coaxial cable as a replacement for the ground plane or a replacement for one of the elements of a dipole antenna. However, these antenna systems do not work well because the coaxial cable length and routing are not generally controlled, akin to taking a normal dipole antenna and stretching one of the dipole elements to a very long length in directions that are not on the same axis as the other dipole element. However, if the routing and length are controlled and characterized, then this technique can work acceptably with the requirement that the length of the coaxial cable must be at least as long as one of the elements of a dipole antenna at the desired frequency of operation and that the antenna system will not work if there is no coaxial cable. As coaxial helix antennas can be directly driven, they do not suffer from these limitations of the prior art antenna systems.

The inner element 124 and/or outer element 122 can be manufacturer using any conductive material, such as copper, as appropriate to the requirements of specific applications of embodiments of the invention. In the illustrated embodiments, the coaxial helix antenna 120 is directly connected to the coaxial cable 110. However, it should be appreciated that any connector, such as a Bayonet Neill-Concelman (BNC) connector and Threaded Neill-Concelman (TNC) connector, can be utilized to electrically couple the coaxial cable to the coaxial helix antenna in accordance with embodiments of the invention. In several embodiments, a connector includes a mating connector, such that when the connector is engaged with the mating connector an electrical coupling between the connector and the mating connector is established.

Figure 2:
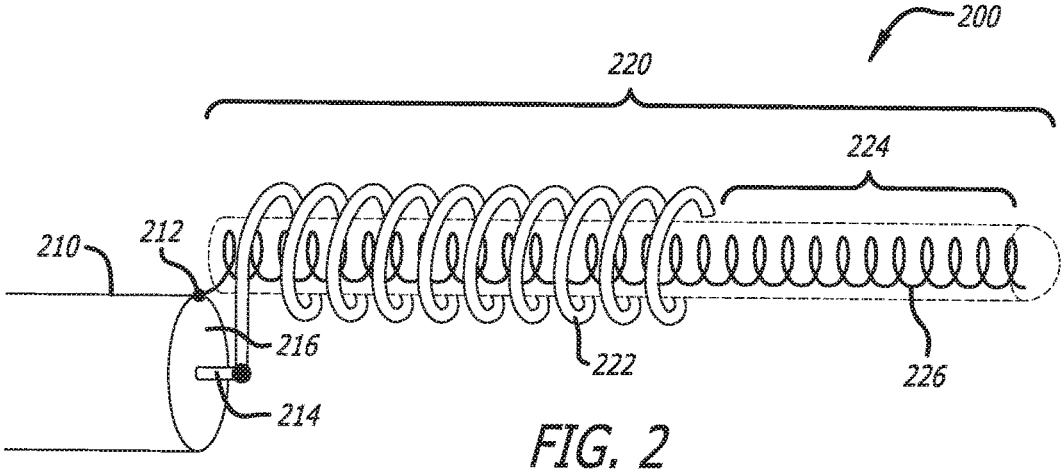
FIG. 2 is a conceptual illustration of a coaxial helix antenna showing the inner element in accordance with an embodiment of the invention.

Turning now to FIG. 2, a coaxial helix antenna system in accordance with an embodiment of the invention is shown. The coaxial helix antenna system 200 includes a coaxial cable 210 and a coaxial helix antenna 220. The coaxial cable 210 includes an outer shield 212 and a conductor 214 separated by an insulator 216. The coaxial helix antenna 220 includes an outer element 222 and an inner element 226. In many embodiments, the inner element 226 and the outer element 222 are separated by an insulating layer, shown as dashed lines. In a number of embodiments, the length of the outer element 222 and the inner element 226 are equal when straightened so that, when the inner element 226 and outer element 222 are coiled, the length of the inner element 226 is greater than the length of the outer element 222. That is the outer element 222 is a coiled wire with an outer element radius and the inner element 226 is a coiled wire with an inner element radius, where the outer element radius is greater than the inner element radius. In a number of embodiments, the outer element 222 is wound in a clockwise fashion, while the inner element 226 is wound in a counter-clockwise fashion, although any winding of the inner and outer elements can be utilized in accordance with embodiments of the invention. Accordingly, the resonant length of the transmission line formed by the outer element 222 is shorter than the resonant length of the inner element 226. Thus, if the inner element 226 is made long enough to be resonant for a desired frequency, it will protrude beyond the end of the outer element 226; the protruding portion of the inner element 226 is indicated as element 224 in FIG. 2. The protrusion 224 will radiate as it is outside of the transmission line defined by outer element 222. However, outer element 222 will also radiate as the phases of the currents generated in inner element 226 and outer element 222 are not equal (due to their unequal lengths). In several embodiments, the inner element 226 and the outer element 222 are perpendicularly coupled and not tightly coupled due to the inner and outer elements being wound in an opposite fashion to each other. In this way, the perpendicular coupling contributes to radiation as too tight a coupling between the coils inhibits radiation of the coaxial helix antenna 220.

In several embodiments, the coaxial helix antenna 220 is driven by the coaxial cable 210. As shown in FIG. 2, the outer element 222 is driven by the conductor 214, while the outer shield 212 is used to driver the inner element 226. In a number of embodiments, the illustrated connections maximize the radiation of the outer element 222 by causing a common mode impedance discontinuity and thus promoting antenna resonance. In many embodiments, this cross connection of elements between the coaxial cable and the coaxial helix antenna (e.g. the connection between the conductor 214 and the outer element 222 and the outer shield 212 and the inner element 226) stabilizes resonance of the coaxial helix antenna along with inducing currents on the outside of the outer shield 212 of the coaxial cable 210. Although such currents are undesirable in prior art antennas as these currents can detune the prior art antennas, this does not affect coaxial helix antennas. This is due to the tuning of the coaxial helix antenna being stabilized by the resonance of the inner element 226 and outer element 222 such that the currents induced in the coaxial cable 210 can be used to increase radiation from the coaxial cable 210.

Figure 3:
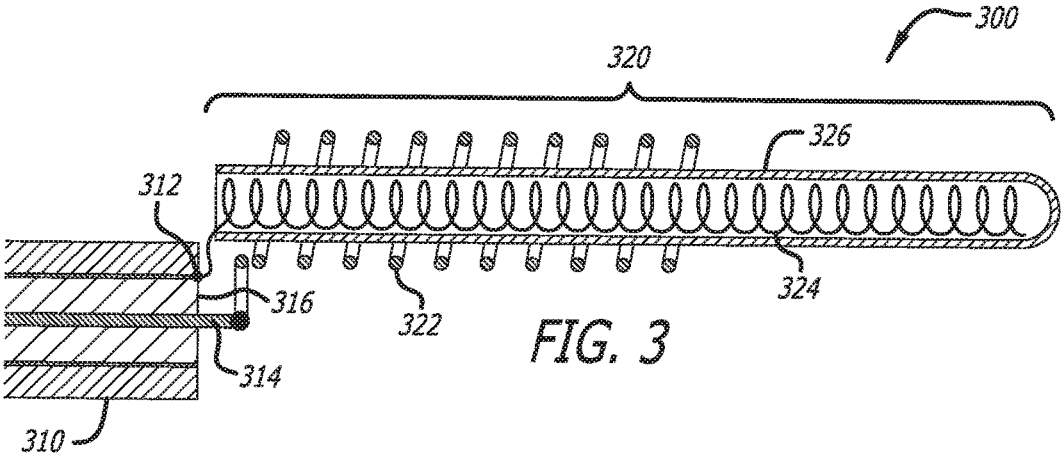
FIG. 3 is a conceptual illustration of a cross section of a coaxial helix antenna in accordance with an embodiment of the invention.

Turning now to FIG. 3, a cross-section of a coaxial helix antenna system in accordance with an embodiment of the invention is shown. The coaxial helix antenna system 300 includes a coaxial helix antenna 320 and a coaxial cable having an outer cover 310, an outer shield 312, an insulator 316, and a conductor 314. The coaxial helix antenna 320 includes an outer element 322, an inner element 324, and, in a variety of embodiments, an insulator 326. As illustrated in FIG. 3, the inner element 324 and the outer element 322 are coiled wires. However, it should be noted that, particularly, when the overall length of the coaxial helix antenna 320 does not need to be minimized, the inner element 324 be a straight wire as appropriate to the requirements of specific applications of embodiments of the invention. Additionally, the distance between the turns of the inner and outer elements can be fixed and/or varied based on the desired frequency for the coaxial helix antenna. It should be noted that the inner element and the outer element can have different inter-turn spacing as appropriate to the requirements of specific applications of embodiments of the invention.

Although a variety of coaxial helix antennas in accordance with embodiments of the invention are described herein and shown in FIGS. 1-3, it should be appreciated that alternative designs, including those that are directly driven and those that are driven by cables other than coaxial cables, can be utilized as appropriate to the requirements of specific applications of embodiments of the invention. Additional details regarding the size and application of coaxial helix antennas in accordance with embodiments of the invention are described in more detail herein.

Applications of Coaxial Helix Antennas

One application that can benefit from the use of small, easily concealed antennas that perform well in environments having a large amount of conductive materials is in stolen vehicle recovery systems. Stolen vehicle recovery systems commonly include one or more locating units installed within a vehicle. These locating units (and their antennas) are commonly hidden within the metal structure of the vehicle. Systems and methods for locating units that can be utilized in accordance with embodiments of the invention are described in U.S. Pat. No. 8,013,735, issued Sep. 6, 2011 and U.S. Pat. No. 9,088,398, issued Jul. 21, 2015. The vehicle locating systems further include a network of communication towers, vehicle tracking units, and a network center with a database of customers who have purchased locating units. When the network center is notified that a vehicle has been stolen, the network center causes the communication towers to transmit a message; this message activates the locating unit installed in the vehicle. The activated locating unit broadcasts a signal that can be detected by the vehicle tracking units that can then locate the vehicle and effect its recovery. Systems and methods for synchronizing communications in a vehicle locating system that can be used in accordance with embodiments of the invention are disclosed in U.S. Pat. No. 8,630,605, issued Jan. 14, 2014. In many vehicle recovery systems, the locating units installed in vehicles that have not been stolen can, on receiving a signal that a vehicle has been stolen, repeat the signal broadcasted by the communication towers. This repeating action can be utilized to increase the coverage area of the vehicle locating system. Systems and methods for vehicle recovery systems that can be utilized in accordance with embodiments of the invention are described in U.S. Pat. No. 8,787,823, issued Jul. 22, 2014. The disclosures of U.S. Pat. Nos. 8,013,735, 8,630,605, 8,787,823, and 9,088,398 are hereby incorporated by reference in their entirety.

A second application that can benefit from a small antenna that performs well within environments having conductive materials are vehicle telematics systems. Vehicle telematics systems can include vehicle telematics devices installed within a vehicle or any other asset to be tracked. The vehicle telematics units can then obtain a variety of data regarding the location and/or operation of the asset. The vehicle telematics units can then provide the data to remote server systems. Systems and methods for vehicle telematics devices that can obtain data from a variety of sources, including a vehicle data bus, that can be utilized in accordance with embodiments of the invention are described in U.S. Pat. No. 9,171,460, issued Oct. 27, 2015. Systems and methods for obtaining data and determining the location of events described by the obtained data using vehicle telematics devices that can be utilized in accordance with embodiments of the invention are described in U.S. Pat. No. 9,406,222, issued Aug. 2, 2016. The disclosures of U.S. Pat. Nos. 9,171,460 and 9,406,222 are hereby incorporated by reference in their entirety.

Dimensions of Coaxial Helix Antennas

As described herein, coaxial helix antennas can be employed in a variety of applications that communicate signals at a variety of RF frequencies. For a given frequency, a coaxial helix antenna can include inner and outer elements that have a length based on the desired frequency for the coaxial helix antenna to resonate. This length can be the full wavelength desired or any fraction thereof. In many embodiments, half-wavelengths and/or quarter-wavelengths are used. The following table provides a summary of common frequencies utilized in accordance with embodiments of the invention along with the approximate length for the inner and outer elements for full-, half-, and quarter-wavelengths:

| Frequency | Full Wavelength | Half Wavelength | Quarter Wavelength |
|---|---|---|---|
| 173 MHz | 0.824 meters | 0.412 meters | 0.206 meters |
| 700 MHz | 0.204 meters | 0.102 meters | 0.051 meters |
| 800 MHz | 0.178 meters | 0.089 meters | 0.0445 meters |
| 850 MHz | 0.168 meters | 0.084 meters | 0.042 meters |
| 900 MHz | 0.158 meters | 0.079 meters | 0.0395 meters |
| 1176 MHz | 0.122 meters | 0.061 meters | 0.0305 meters |
| 1227 MHz | 0.116 meters | 0.058 meters | 0.029 meters |
| 1500 MHz | 0.096 meters | 0.048 meters | 0.024 meters |
| 1575 MHz | 0.090 meters | 0.045 meters | 0.0225 meters |
| 1700 MHz | 0.084 meters | 0.042 meters | 0.021 meters |
| 1800 MHz | 0.080 meters | 0.040 meters | 0.020 meters |
| 1900 MHz | 0.076 meters | 0.038 meters | 0.019 meters |
| 2100 MHz | 0.068 meters | 0.034 meters | 0.017 meters |
| 2441 MHz | 0.058 meters | 0.029 meters | 0.0145 meters |
| 2600 MHz | 0.054 meters | 0.027 meters | 0.0135 meters |
| 5437 MHz | 0.026 meters | 0.013 meters | 0.0065 meters |

It should be appreciated that the herein table is provided as an example only and that other frequencies and antenna lengths that are substantially similar can be utilized as appropriate to the requirements of specific applications of embodiments of the invention. Additionally, the herein table provides the length of the inner and outer element only. Depending on the inner element radius and the outer element radius selected for a specific embodiment of the invention, the total length of the coaxial helix antenna and the protrusion of the inner element from the outer element can vary and will likely be shorter than the values provided herein. In a variety of embodiments, the inner element radius and/or the outer element radius is calculated by performing an electromagnetic simulation of the coaxial helix antenna for the frequency at which the coaxial helix antenna is tuned.

In a number of embodiments, the effectiveness of a coaxial helix antenna diminishes at higher frequencies as the cancellation of the downward frequency detuning resulting from the capacitive field being in proximity to metal by the upward frequency detuning resulting from the inductive field being in proximity to metal depends on having multiple turns in the outer element. At higher frequencies, there may not be enough turns on the outer element to affect this cancellation. However, a variety of techniques can be utilized to lengthen the inner and/or outer elements in order to improve the cancellation of the magnetic and electrical fields in order to stabilize the antenna. First, the coaxial helix antenna can be constructed using elements that are longer than a half-wavelength at the desired frequency. Prior art antenna systems tend to exhibit decreased performance as the antenna length increases as these systems exhibit more directive radiation patterns whereby more radiation is directed toward certain directions and less radiation is directed toward other directions. Accordingly, these prior art antenna systems do not work well in the presence of conductive materials because the directions of the energy peaks are altered by the conductive materials. However, coaxial helix antennas, although potentially affected by the directive radiation patterns caused by the longer element lengths, are less affected by the presence of conductive materials due to the coaxial helix antenna being capable of stabilizing its resonant frequency even in the presence of conductive materials. In addition to utilizing longer elements (i.e., elements longer than a half-wavelength), additional techniques can be utilized to artificially lengthen the antenna. These techniques can include, but are not limited to, introducing an insulator and/or dielectric between the turns of the inner element and/or outer element, increasing the distance between the turns of the inner element and/or outer element, and reducing the radius of the coils of the inner element and/or outer element. However, any other technique to artificially lengthen the inner and/or outer elements can be utilized as appropriate to the requirements of specific applications of embodiments of the invention.

Although the embodiments have been described in certain specific aspects, many additional modifications and variations would be apparent to those skilled in the art. In particular, any of the various processes described herein can be performed in alternative sequences in order to achieve similar results in a manner that is more appropriate to the requirements of a specific application. It is therefore to be understood that the embodiments can be practiced otherwise than specifically described without departing from the scope and spirit of the embodiments. Thus, embodiments should be considered in all respects as illustrative and not restrictive. It will be evident to the person skilled in the art to freely combine several or all of the embodiments discussed here as deemed suitable for a specific application of the invention. Throughout this disclosure, terms like "advantageous", "exemplary" or "preferred" indicate elements or dimensions which are particularly suitable (but not essential) to the invention or an embodiment thereof, and may be modified wherever deemed suitable by the skilled person, except where expressly required. Accordingly, the scope of the invention should be determined not by the embodiments illustrated, but by the appended claims and their equivalents.

What is claimed is:

1. A coaxial helix antenna, comprising:

a helical inner element having an inner element radius and an inner element length; and a helical outer element having an outer element radius and an outer element length;

wherein the outer element radius is greater than the inner element radius;

wherein the helical inner element is driven by a first conductor;

wherein the helical outer element is driven by a second conductor;

wherein the helical outer element is disposed outside of the helical inner element such that a portion of the helical inner element extends within the helical outer element and another portion of the helical inner element extends beyond the helical outer element and comprises an inner radiating element; and wherein the helical outer element and the helical inner element are wound in an opposite manner;

wherein the coaxial helix antenna is coupled to a coaxial cable; and the coaxial cable comprises a conductor and an outer shield and the helical outer element and the helical inner element are cross connected to the conductor and the outer shield of the coaxial cable to stabilize resonance of the coaxial helix antenna and to induce currents on the outside of the outer shield of the coaxial cable;

wherein the helical outer element is coupled to the conductor such that the second conductor comprises the conductor of the coaxial cable; and the helical inner element is coupled to the outer shield such that the first conductor comprises the outer shield of the coaxial cable.

2. The coaxial helix antenna of claim 1, wherein:

the coaxial helix antenna further comprises a BNC (Bayonet Neill-Concelman) connector;

the helical inner element and the helical outer element are coupled to the BNC connector;

the coaxial cable is coupled to a mating BNC connector capable of engaging with the BNC connector;

the helical inner element is electrically coupled to the outer shield via the BNC connector when engaged with the mating BNC connector; and the helical outer element is electrically coupled to the conductor via the BNC connector when engaged with the mating BNC connector.

3. The coaxial helix antenna of claim 1, wherein:

the helical outer element is wound in a clockwise manner; and the helical inner element is wound in a counter-clockwise manner.

4. The coaxial helix antenna of claim 1, wherein:

the helical inner element is wound in a clockwise manner; and the helical outer element is wound in a counter-clockwise manner.

5. The coaxial helix antenna of claim 1, wherein:

the coaxial helix antenna is installed within the frame of a vehicle; and the frame of the vehicle is constructed using a conductive material.

6. The coaxial helix antenna of claim 1, further comprising an insulator located between the helical inner element and the helical outer element.

7. The coaxial helix antenna of claim 6, wherein the insulator extends beyond the helical outer element around the helical inner element.

8. A coaxial helix antenna system, comprising:

a coaxial cable; and a coaxial helix antenna coupled to the coaxial cable and including:

a helical inner element having an inner element radius and an inner element length; and a helical outer element having an outer element radius and an outer element length;

wherein the outer element radius is greater than the inner element radius;

wherein the helical inner element is driven by a first conductor;

wherein the helical outer element is driven by a second conductor; and wherein the helical outer element is disposed outside of the helical inner element such that a portion of the helical inner element extends within the helical outer element and another portion of the helical inner element extends beyond the helical outer element and comprises an inner radiating element; and wherein the helical outer element and the helical inner element are wound in an opposite manner;

wherein the coaxial cable comprises a center conductor and an outer shield and the helical outer element and the helical inner element are cross connected to the center conductor and the outer shield of the coaxial cable to stabilize resonance of the coaxial helix antenna and to induce currents on the outside of the outer shield of the coaxial cable;

wherein the second conductor is the center conductor of the coaxial cable and the helical outer element is coupled to the center conductor; and wherein the first conductor is the outer shield of the coaxial cable and the helical inner element is coupled to the outer shield.

9. The coaxial helix antenna system of claim 8, wherein: the coaxial helix antenna further comprises a connector; the helical inner element and the helical outer element are coupled to the connector; the coaxial cable is coupled to a mating connector capable of engaging with the connector; the helical inner element is electrically coupled to the outer shield via the connector when engaged with the mating connector; and the helical outer element is electrically coupled to the conductor via the connector when engaged with the mating connector.

10. The coaxial helix antenna system of claim 8, wherein:

the helical outer element is wound in a clockwise manner; and the helical inner element is wound in a counter-clockwise manner.

11. The coaxial helix antenna system of claim 8, wherein:

the helical inner element is wound in a clockwise manner; and the helical outer element is wound in a counter-clockwise manner.

12. The coaxial helix antenna system of claim 8, wherein:

the coaxial helix antenna is installed within the frame of a vehicle; and the frame of the vehicle is constructed using a conductive material.

13. The coaxial helix antenna system of claim 8, further comprising an insulator located between the helical inner element and the helical outer element.

14. The coaxial helix antenna system of claim 13, wherein the insulator extends beyond the helical outer element around the helical inner element.

* * * * *